US011857823B1

(12) United States Patent
Crouch

(10) Patent No.: US 11,857,823 B1
(45) Date of Patent: Jan. 2, 2024

(54) TRAINING DEVICE AND METHOD FOR IMPROVING RELEASE VELOCITY AND ACCURACY WHEN THROWING A FLYING DISC

(71) Applicant: Lawrence Andrew Crouch, Harrisburg, NC (US)

(72) Inventor: Lawrence Andrew Crouch, Harrisburg, NC (US)

( * ) Notice: Subject to any disclaimer, the term of this patent is extended or adjusted under 35 U.S.C. 154(b) by 285 days.

(21) Appl. No.: 16/732,940

(22) Filed: Jan. 2, 2020

Related U.S. Application Data

(60) Provisional application No. 62/787,562, filed on Jan. 2, 2019.

(51) Int. Cl.

| | |
|---|---|
| ***A63B 21/04*** | (2006.01) |
| ***A63B 21/055*** | (2006.01) |
| ***A63B 21/06*** | (2006.01) |
| ***A63B 21/00*** | (2006.01) |
| ***A63B 23/035*** | (2006.01) |
| ***A63B 21/16*** | (2006.01) |

(52) U.S. Cl.
CPC ..... *A63B 21/0442* (2013.01); *A63B 21/0557* (2013.01); *A63B 21/0607* (2013.01); *A63B 21/1645* (2013.01); *A63B 21/4021* (2015.10); *A63B 23/03508* (2013.01); *A63B 2244/15* (2013.01)

(58) Field of Classification Search
CPC ..... A63B 21/0442; A63B 21/4021; A63B 21/0557; A63B 21/0607; A63B 21/1645; A63B 23/03508; A63B 2244/15; A63F 9/02
USPC ..... 473/423, 425, 427, 429, 430, 506, 508
See application file for complete search history.

(56) References Cited

U.S. PATENT DOCUMENTS

| | | | | |
|---|---|---|---|---|
| 3,976,297 | A * | 8/1976 | Seymour | A63F 9/02 473/588 |
| 4,802,875 | A * | 2/1989 | Cunningham | A63H 33/18 446/228 |
| D324,114 | S * | 2/1992 | Batrick | D21/444 |
| 5,254,077 | A * | 10/1993 | Nottingham | A63H 27/082 473/589 |
| 5,531,624 | A * | 7/1996 | Dunipace | A63B 65/10 473/588 |
| 2004/0198137 | A1* | 10/2004 | Ruiz | A63H 33/18 446/46 |

(Continued)

OTHER PUBLICATIONS

NPL 1: https://www.youtube.com/channel/UCtAQfPEEE2CLKhQBgb4VBfQ; Pro Pull Disc; Dates: Jan. 30, 2018.*

(Continued)

*Primary Examiner* — Andrew S Lo
*Assistant Examiner* — Andrew M Kobylarz
(74) *Attorney, Agent, or Firm* — Schwartz Law Firm, P.C.

(57) ABSTRACT

A flying disc training device incorporates a training disc for being gripped by a user, and having a centerpoint, top and bottom sides and an annular rim. A swivel strap includes first and second ends pivotably attached at the centerpoint of the disc on respective top and bottom sides. The swivel strap forms an intermediate loop which extends beyond the annular rim of the disc, such that the swivel strap is capable of freely pivoting relative to the disc. An elastic resistance band is attached to the swivel strap and has a free end adapted for being secured to a fixed structure.

21 Claims, 11 Drawing Sheets

(56) References Cited

U.S. PATENT DOCUMENTS

2008/0125001 A1* 5/2008 Barniak ..... A63H 33/18 446/46
2015/0209608 A1* 7/2015 Hernandez ..... A63B 21/4037 482/123

OTHER PUBLICATIONS https://www.amazon.com/Innova-Kahuna-Heavyweight-Ultimate-Disc-Tiki/dp/B01HFHSNKO/ref=asc_df_B01HFHSNKO/?tag=hyprod-20&linkCode=df0&hvadid=198101676703&hvpos=&hvnetw=g&hvrand=16654695189353973 93&hvpone=&hvptwo=&hvqmt=&hvdev=c&hvdvcmdl=&hvlocint=&hvlocphy=9008148&hvtargid=pla-319284051040&psc=1; Innova; Jan. 12, 2016.*
https://www.walmart.com/ip/Single-Stackable-Resistance-Band-5-lb-to-8-lb/49254247?wmlspartner=wlpa&selectedSellerId=0; Single Stackable Resistance Band; Oct. 26, 2017.*
NPL 2: https://www.youtube.com/watch?v=IS9ETyO9XHE; ProPull Disc Golf Setup Instructions; Dates: Jan. 12, 2018.*
NPL 3: https://www.youtube.com/watch?v=de_Cyi4h6DE; Date: Jun. 27, 2018.*
NPL 4: https://www.amazon.com/Innova-Kahuna-200g-Ultimate-Catch/dp/B01AINDYC4/ref=asc_df_B01AINDYC4/?tag=hyprod-20&linkCode=df0&hvadid=167128853713&hvpos=&hvnetw=g&hvrand=5873333105473002119&hvpone=&hvptwo=&hvqmt=&hvdev=c&hvdvcmdl=&hvlocint=&hvlocphy=9008148&hvtargid=pla-379123748397&th=1; Date: Jan. 12, 2016.*
NPL 5: https://www.walmart.com/ip/Single-Stackable-Resistance-Band-5-lb-to-8-lb/49254247?wmlspartner=wlpa&selectedSellerId=0&&adid=22222222227000000000&wl0=&wl1=g&wl2=c&wl3=42423897272&wl4=pla-51320962143&wl5=9008148&wl6=&wl7=&wl8=&wl9=pla&wl10=8175035&wl11=online&wl12=49254247&veh=sem&gclid=EAlalQobChMIsLCB6eS18A.*
NPL 6: https://www.youtube.com/watch?v=KGUVFpdkmX0; Powersnap; Date: Mar. 2, 2016.*
NPL 1: https://www.youtube.com/watch?v=KGUVFpdkmX0 (Year: 2016).*
NPL 2:https://www.facebook.com/powersnapdiscgolf/ (Year: 2016).*
NPL 3:https://www.amazon.com/Innova-Kahuna-Heavyweight-Ultimate-Disc-Tiki/dp/B01HFHSNKO/ref=asc_df_B01HFHSNKO/?tag=hyprod-20&linkCode=df0&hvadid=198101676703&hvpos=&hvnetw=g&hvrand=16654695189353973 93&hvpone=&hvptwo=& hvqmt=&hvdev=c&hvdvcmdl=&hvlocint=&hvlocphy=9008148&hvtargid=pla-319284051040&psc=1; (Year: 2016).*
NPL 4:https://www.walmart.com/ip/Single-Stackable-Resistance-Band-5-lb-to-8-lb/49254247?wmlspartner=wlpa&selectedSellerId=0; Single Stackable Resistance Band; Oct. 26, 2017 (Year: 2017).*
NPL 1: https://www.youtube.com/channel/UCtAQfPEEE2CLKhQBgb4VBfQ; Pro Pull Disc; Dates: Jan. 30, 2018 (Year: 2018).*
https://www.amazon.com/Innova-Kahuna-Heavyweight-Ultimate-Disc-Tiki/dp/B01HFHSNKO/ref=asc_df_B01HFHSNKO/?tag=hyprod-20&linkCode=df0&hvadid=198101676703&hvpos=&hvnetw=g&hvrand=16654695189353973 93&hvpone=&hvptwo=&hvqmt=&hvdev=c&hvdvcmdl=&hvlocint=&hvlocphy=9008148&hvtargid=pla-319284051040&psc=1; (Year: 2018).*
https://www.walmart.com/ip/Single-Stackable-Resistance-Band-5-lb-to-8-lb/49254247?wmlspartner=wlpa&selectedSellerId=0; Single Stackable Resistance Band; (Year: 2017).*
NPL 2: https://www.youtube.com/watch?v=IS9ETyO9XHE; ProPull Disc Golf Setup Instructions; Dates: Jan. 12, 2018 (Year: 2018).*
NPL 3: https://www.youtube.com/watch?v=de_Cyi4h6DE; Date: Jun. 27, 2018 (Year: 2018).*
NPL 4: https://www.amazon.com/Innova-Kahuna-200g-Ultimate-Catch/dp/B01AINDYC4/ref=asc_df_B01AINDYC4/?tag=hyprod20&linkCode=df0&hvadid=167128853713&hvpos=&hvnetw=g&hvrand=5873333105473002119&hvpone=&hvptwo=&hvqmt=&hvdev=c&hvdvcmdl=&hvlocint=&hvlocphy=9008148&hvtargid=pla-379123748397&th=1; (Year: 2016).*
NPL 5: https://www.walmart.com/ip/Single-Stackable-Resistance-Band-5-lb-to-8-lb/49254247?wmlspartner=wlpa&selectedSellerId=0&&adid=22222222227000000000&wl0=&wl1=g&wl2=c&wl3=42423897272&wl4=pla-51320962143&wl5=9008148&wl6=&wl7=&wl8=&wl9=pla&wl10=8175035&wl11=online&wl12=49254247&veh=sem&gclid=EAla (Year: 2017).*
NPL 6: https://www.youtube.com/watch?v=KGUVFpdkmX0; Powersnap; Date: Mar. 2, 2016 (Year: 2016).*

* cited by examiner

TRAINING DEVICE AND METHOD FOR IMPROVING RELEASE VELOCITY AND ACCURACY WHEN THROWING A FLYING DISC

TECHNICAL FIELD AND BACKGROUND OF THE DISCLOSURE

The present disclosure relates broadly and generally to a training device and method for improving release velocity and accuracy when throwing a flying disc. In one exemplary implementation, the invention is applicable for training disc golf players to throw flying discs with greater distance and increased accuracy in the game of disc golf.

The game of disc golf is played in a similar way to the game of traditional golf. When playing traditional golf, the object of the game is to "hit" a golf ball into a hole. When playing disc golf, the object is to throw a flying disc into an elevated basket fitted with hanging chains, which catch the disc and drop it into a metal enclosure. Both games use much of the same terminology to describe the same occurrences. For example, both games use the term "Round" to describe a full game, both games use 18 Holes to define a Round, both games use the term "Hole" to describe an individual segment of the 18 Holes within a Round and both use the word "Shot" to describe the "hit" in traditional golf and the "throw" in disc golf. Both games use the terms to describe the actual playing of Holes. Both games use the term "Tee" to describe the location of the first Shot on a Hole, and both use the term "Drive" to describe the first Shot on each of the 18 holes. Both games are fundamentally competitive because they count the total number of shots it takes to complete each hole and combine the total shots on each hole to determine the score for the round. In both games, player improvement is important because the player with the lowest number of shots wins.

In disc golf, there are three types of throws that are greatly benefitted by increased distance: (a) long distance drives, (b) fairway throws, and (c) mid-range throws. However, adding distance to these throws without accuracy is of limited value. When throwing a flying disc, there are four primary factors that determine whether the disc will hit its intended target: (a) release velocity, (b) release angle, (c) release height, and (d) target line. If any one of these four factors is not correct, the target will not be hit and the throw will be less than ideal. As such, one of the defining characteristics of the best disc golf players is how far they are able to throw a flying disc with accuracy.

Top level professional players can throw discs to targets that are 550 feet away. A recent survey by Infinite Discs shows that 38% of players are unable to throw a disc 300 feet, and only 11% of players can throw over 400 feet. The current guidelines for the average length of disc golf holes by the Professional Disc Golf Association is between 250 and 333 feet for average amateur players. The average hole length for tournament level players is greater than 333 feet with no limit on the maximum length of a hole. According to the "Course Design Guidelines for PDGA Skill Levels & Divisions" the longest holes in the world are around 1,200 feet. Therefore, a key element of player improvement is increasing the distance players are able to throw a disc. It is estimated that for every 1 mile per hour of disc speed the disc will travel 7.2 feet. Therefore, increasing the speed at which the disc is flying by only 10 miles per hour will result in an additional 72 feet of distance.

In addition, disc golf is a target game and every successful throw includes distance and direction. The angle of the disc when released, relative to the ground, determines whether the disc will fly straight, left, or right. Therefore, proper training for the disc golf throw requires a device that trains the angle of release as well as the muscles used during play.

One previous attempt to train the disc golf throw using resistance bands connects two ends of a single folded nylon rope through a hand punctured hole in the center of the upper plane of a standard (previously used) flying disc manufactured for on-the-course play. Each end of the nylon rope, one folded over the top of the upper plane of the disc and the other nylon rope end folded under the disc, are glued to each end of a plastic plug inserted through the punctured hole in the center of the disc. One end of a single resistance band is then hand tied with a knot to the midpoint of the nylon rope where the fold occurs. The other end of the resistance band is hand tied to a second nylon rope which serves as the anchor device.

This prior art attempt at a disc golf training device is unsatisfactory for a number of critical reasons. Using a standard off-the-shelf disc manufactured for course play requires the puncturing of the thinnest section of the upper plane of the disc which is not designed to be punctured. This undesigned center point junction is a critical location of the device. Due to the forces applied to the thin edges of the punctured upper plane during resistance training, the punctured hole at the thinnest section of the disc will deform and tear with relatively limited use. In addition, as the thin punctured hole deforms under force it flexes, thus altering the plane of the disc relative to the position of the hand that is gripping the disc, causing the user to train muscle memory with an incorrect release angle.

This attempt also misses a primary function due to its construction. The resistance band is fixed to the prior art device, and this device therefore offers no ability to custom increase or reduce resistance levels or values to suit the particular user. Proper and effective resistance training requires varied levels of resistance to gain strength and improve muscle memory. The exemplary training device of the present disclosure is a novel concept designed to create a stable, freely rotating disc that can be used for proper resistance training while effectively mimicking a disc approved by the Professional Disc Golf Association for tournament play.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a flying disc training device. The training device incorporates a training disc for being gripped by a user, and having a centerpoint, top and bottom sides and an annular rim. A swivel strap includes first and second ends pivotably attached at the centerpoint of the disc on respective top and bottom sides. The swivel strap forms an intermediate loop which extends beyond the annular rim of the disc, such that the swivel strap is capable of freely pivoting relative to the disc. An elastic resistance band is attached to the swivel strap and has a free end adapted for being secured (directly or indirectly) to a fixed structure.

The term "resistance band" refers broadly herein to any single integrally-formed cord, strap, rope, line, cable or the like which may be uniformly elastic along its entire length, or partially elastic along its length, or formed using a combination of multiple elastic and inelastic elements.

According to another exemplary embodiment, an exchangeable flexible anchor strap is attached to the free end of the resistance band and is adapted for being releasably secured to the fixed structure. In this embodiment, the elastic resistance band is indirectly secured to the fixed structure using the flexible anchor strap. In alternative embodiments, the elastic resistance band may be attached directly to the fixed structure without the use of a separate anchor strap.

According to another exemplary embodiment, the flexible anchor strap comprises a door anchor adapted for being wedged between a door and door frame.

According to another exemplary embodiment, the anchor strap comprises a flexible nylon tree strap adapted for wrapping around a tree and having at least one looped end.

According to another exemplary embodiment, the free end of the resistance band comprises a fabric band coupler and carabiner. The carabiner is adapted for being releasably attached to the anchor strap.

According to another exemplary embodiment, the resistance band comprises a fabric band coupler and carabiner. The carabiner adapted for being releasably attached to the swivel strap.

According to another exemplary embodiment, a flexible safety wrist tether is releasably attached to the swivel strap.

According to another exemplary embodiment, the wrist tether comprises an adjustable wrist strap.

According to another exemplary embodiment, a second elastic resistance band is attached to the swivel strap and has a free end adapted for being secured to the fixed structure. The second resistance band combines with the first resistance band to increase a resistance level of the training device.

According to another exemplary embodiment, the first and second ends of the swivel strap are folded at the centerpoint of the disc and define respective fastener holes aligned on top and bottom sides of the disc with a centerpoint disc hole.

According to another exemplary embodiment, an integrally-molded annular reinforcement collar is located at the centerpoint disc hole and projects from the bottom side of the disc.

According to another exemplary embodiment, a metal sleeve bearing resides within an opening defined by the reinforcement collar at the centerpoint disc hole.

According to another exemplary embodiment, complementary-threaded male and female fasteners are inserted through the sleeve bearing on respective top and bottom sides of the disc.

According to another exemplary embodiment, the outer rim of the training disc has a maximum thickness between 2-4 cm.

According to another exemplary embodiment, the outer rim of the training disc has a beveled edge.

According to another exemplary embodiment, the training disc is fabricated of a homogenous plastic—i.e., having a uniform composition or structure throughout.

According to another exemplary embodiment, the training disc weighs between 200 and 300 grams.

According to another exemplary embodiment, the training disc is between 20-23 cm in diameter.

According to another exemplary embodiment, the elastic resistance band offers resistance levels of between 5 and 8 pounds.

According to another exemplary embodiment, the elastic resistance band is color-coded to indicate a predetermined resistance level.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Figure 1:
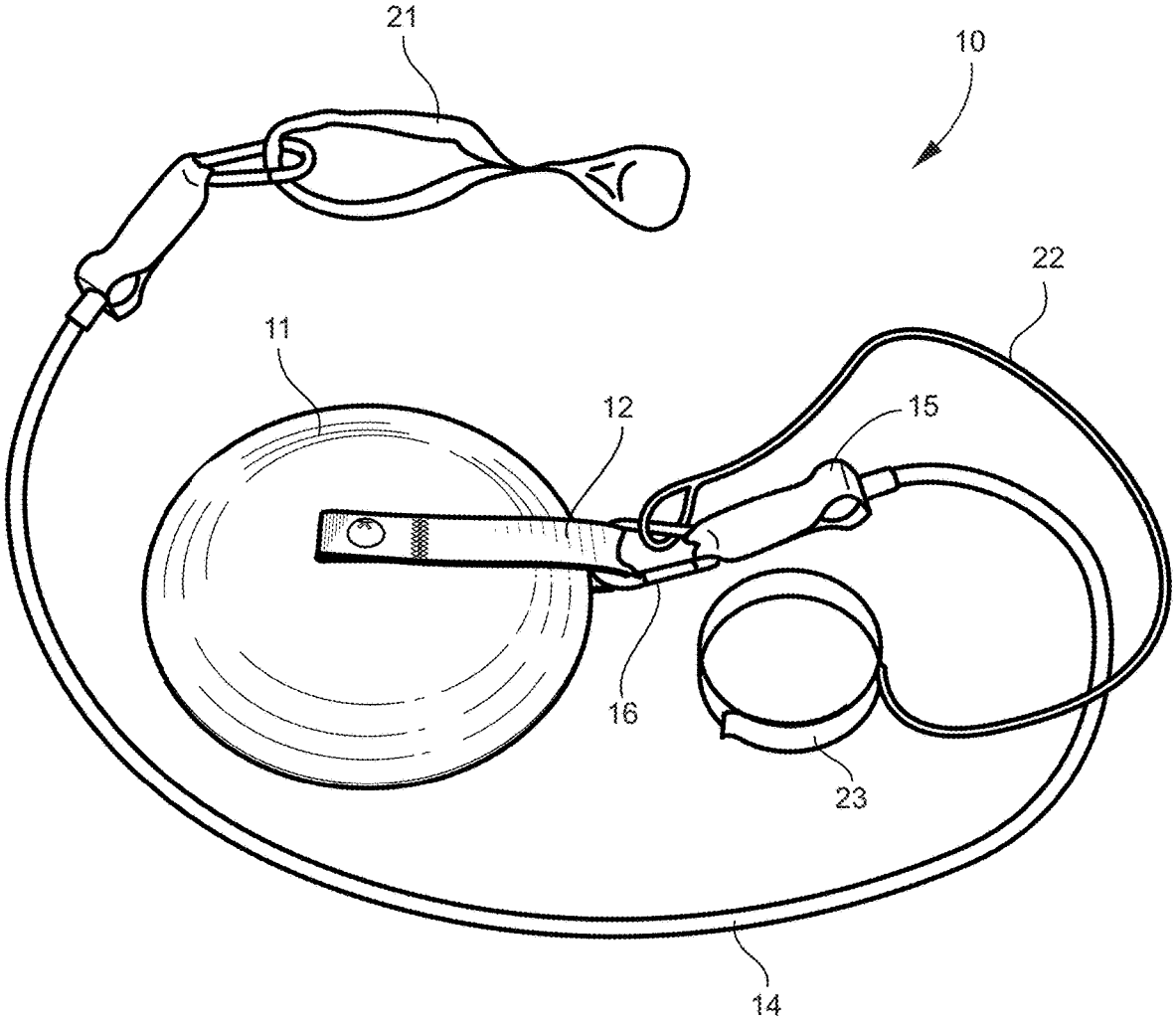
FIG. 1 shows the present flying disc training device according to one exemplary embodiment of the present disclosure.
Figure 2:
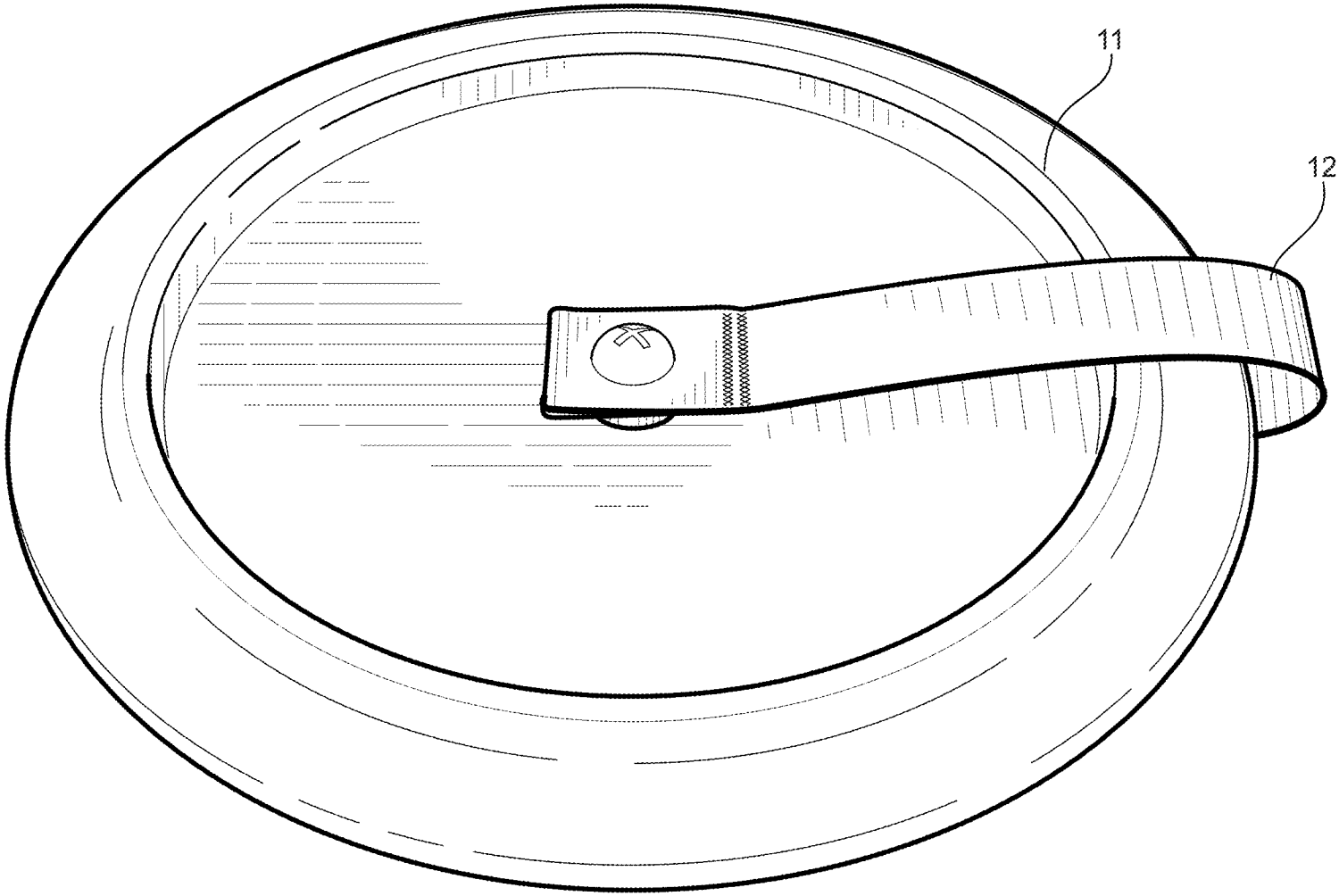
FIG. 2 is a perspective view of the rigid training disc incorporated in the exemplary training device.

Referring now specifically to the drawings, a flying disc training device according to one embodiment of the present disclosure is illustrated in FIG. 1 and shown generally at broad reference numeral 10. The exemplary training device 10 incorporates a rigid training disc 11 for being gripped by a user, a nylon swivel strap 12 attached to the training disc 11, and an exchangeable elastic resistance band 14. The resistance band 14 includes a first nylon band coupler 15 and metal carabiner 16 which releasably attaches to the swivel strap 12. A free end of the resistance band 14 comprises a second fabric band coupler 18 and carabiner 19. The carabiner 19 is adapted for being releasably attached to a selected anchor strap 21. As demonstrated in FIGS. 7-10 and discussed further below, the selected anchor strap 21 is designed for being temporarily secured to a fixed structure when exercising using the exemplary training device 10. A separate flexible safety wrist tether 22 is releasably attached to the swivel strap 12, and may have an adjustable wrist strap 23 to custom fit the particular user.

Used properly in a prescribed routine, such as the exemplary "6 Week Workout" outlined in Table 1, the present training device 10 may function to improve release velocity, distance and accuracy when throwing a flying disc.

TABLE 1

| | DAY 1 | DAY 2 | DAY 3 | DAY 4 | DAY 5 |
|---|---|---|---|---|---|
| WEEK 1 | SPEED WORKOUT<br>2 sets - Yellow Band<br>10-12 Reps | Rest | SPEED WORKOUT<br>2 sets - Yellow Band<br>10-12 Reps | Rest | SPEED WORKOUT<br>2 sets - Yellow Band<br>10-12 Reps |
| WEEK 2 | SPEED WORKOUT<br>3 sets - Yellow Band<br>10-12 Reps | Rest | SPEED WORKOUT<br>3 sets - Yellow Band<br>10-12 Reps | Rest | SPEED WORKOUT<br>3 sets - Yellow Band<br>1 sets - Green Band<br>10-12 Reps |
| WEEK 3 | SPEED WORKOUT<br>3 sets - Yellow Band<br>1 set - Green Band<br>10-12 Reps | Rest | SPEED WORKOUT<br>3 sets - Yellow Band<br>1 set - Green Band<br>10-12 Reps | Rest | SPEED WORKOUT<br>3 sets - Yellow Band<br>1 set - Green Band<br>10-12 Reps |
| WEEK 4 | Release Angle Workout<br>2 Sets - Yellow Band<br>8-10 Reps<br>ISOMETRIC HOLD<br>Yellow & Green Band<br>2 Sets Position 1<br>2 Sets Position #2<br>Hold for 5 seconds Each Set | Rest | Release Angle Workout<br>2 Sets - Yellow Band<br>8-10 Reps<br>ISOMETRIC HOLD<br>Yellow & Green Band<br>2 Sets Position 1<br>2 Sets Position #2<br>Hold for 7 Seconds Each Set | Rest | Release Angle Workout<br>2 Sets - Yellow Band<br>8-10 Reps<br>ISOMETRIC HOLD<br>Yellow & Green Band<br>2 Sets Position 1<br>2 Sets Position #2<br>Hold for 7 Seconds Each Set |
| WEEK 5 | Elbow Pull Workout<br>2 Sets - Yellow Band<br>8-10 Reps<br>ISOMETRIC HOLD<br>Yellow & Green Band<br>2 Sets Position 1<br>2 Sets Position #2<br>Hold for 5 seconds AFTER your muscle starts to shake. | Rest | Elbow Pull Workout<br>2 Sets - Yellow Band<br>8-10 Reps<br>ISOMETRIC HOLD<br>Yellow & Green Band<br>2 Sets Position 1<br>2 Sets Position #2<br>Hold for 5 seconds AFTER your muscle starts to shake. | Rest | Elbow Pull Workout<br>2 Sets - Yellow Band<br>8-10 Reps<br>ISOMETRIC HOLD<br>Yellow & Green Band<br>2 Sets Position 1<br>2 Sets Position #2<br>Hold for 5 seconds AFTER your muscle starts to shake. |
| WEEK 6 | Speed Workout<br>2 Sets - Green Band<br>8-10 Reps<br>ISOMETRIC HOLD<br>Yellow & Green Band<br>2 Sets Position 1<br>2 Sets Position #2<br>Hold for 5 seconds AFTER your muscle starts to shake. | Rest | Speed Workout<br>2 Sets - Green Band<br>8-10 Reps<br>ISOMETRIC HOLD<br>Yellow & Green Band<br>2 Sets Position 1<br>2 Sets Position #2<br>Hold for 5 seconds AFTER your muscle starts to shake. | Rest | Speed Workout<br>2 Sets - Green Band<br>8-10 Reps<br>ISOMETRIC HOLD<br>Yellow & Green Band<br>2 Sets Position 1<br>2 Sets Position #2<br>Hold for 5 seconds AFTER your muscle starts to shake. |

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 3:
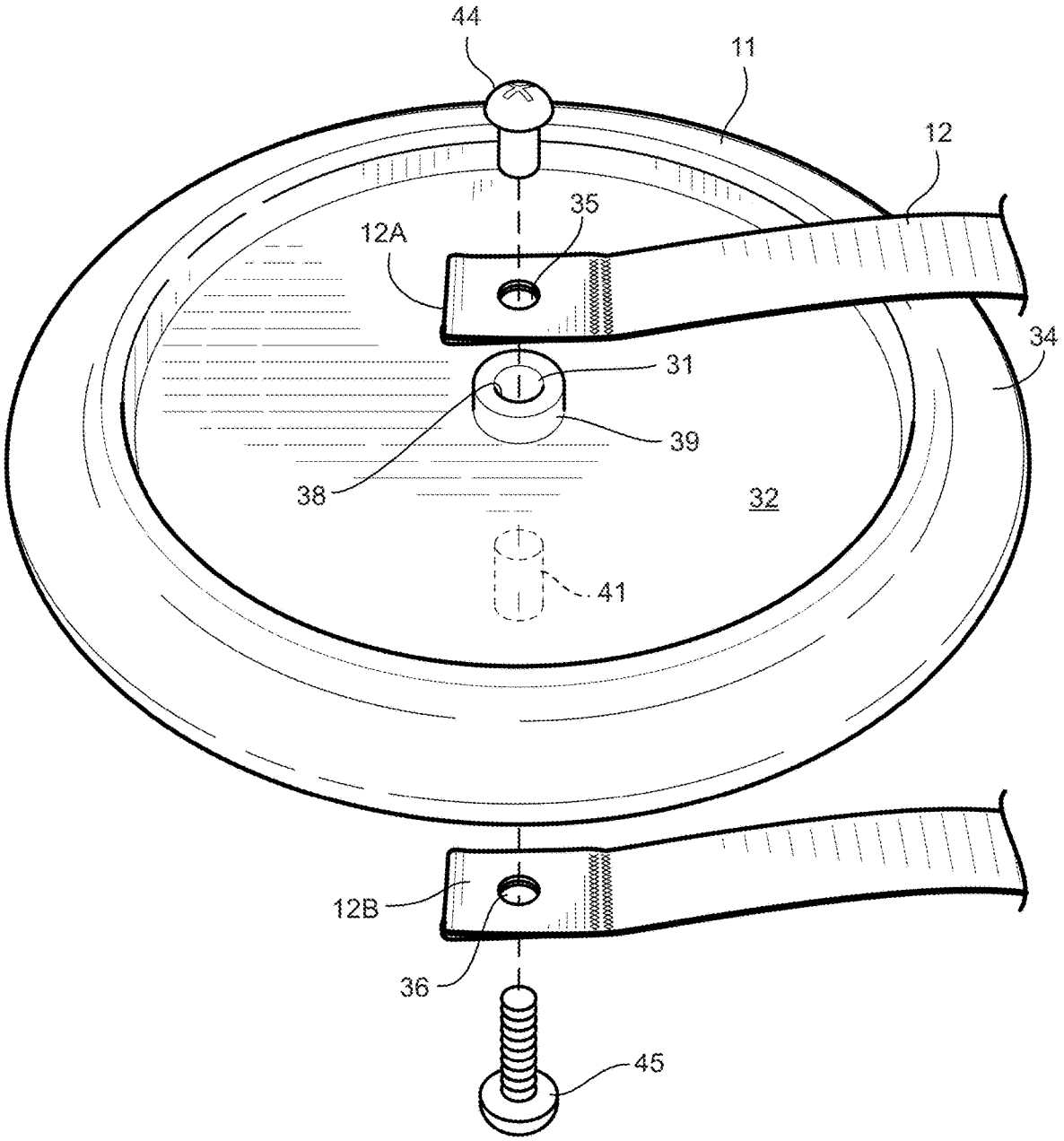
FIG. 3 is a further perspective view the training disc showing fragmentary end portions of the swivel strap and fasteners exploded away.
Figure 4:
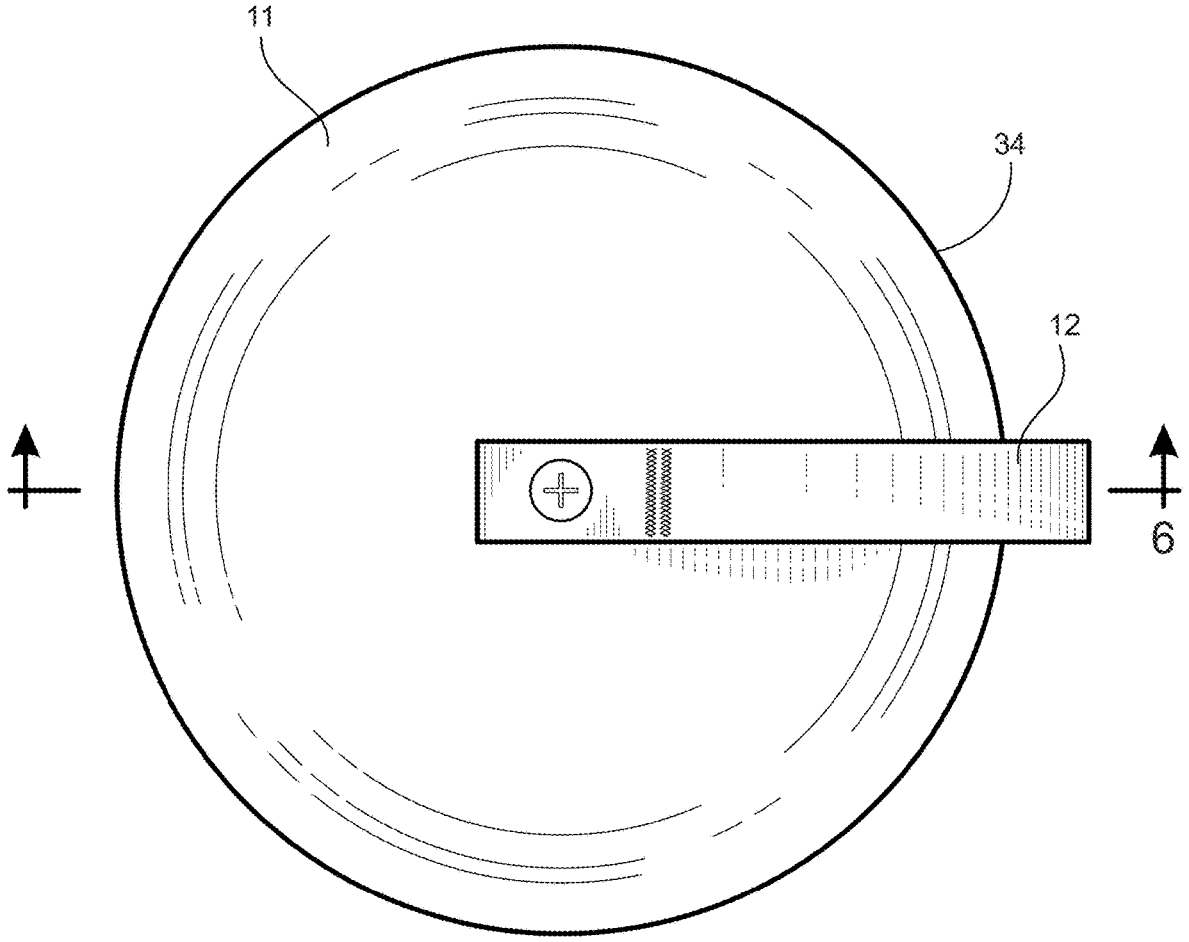
FIG. 4 is top view of the exemplary training disc.
Figure 5:
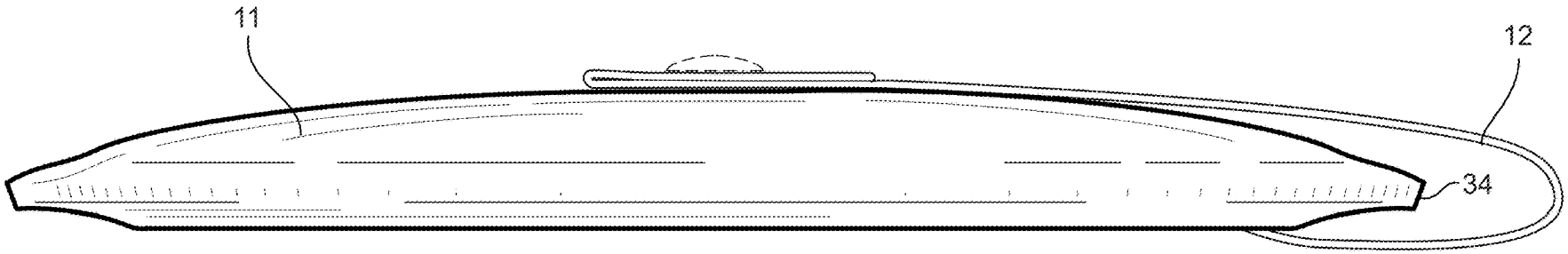
FIG. 5 is a side view of the exemplary training disc.
Figure 6:
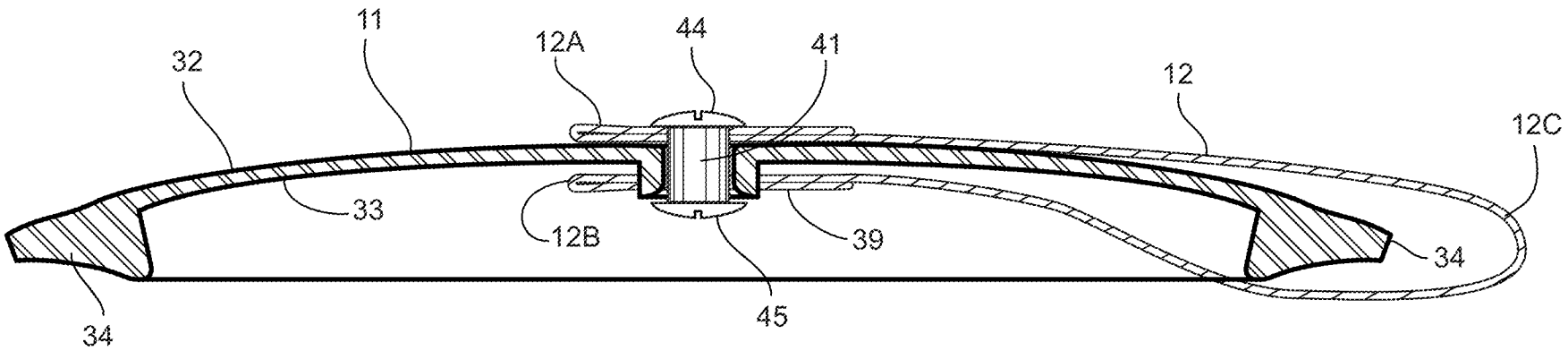
FIG. 6 is a cross-sectional view of the exemplary training disc taken substantially along lines 6-6 of FIG. 4.

Referring to FIGS. 2-6, the exemplary disc 11 of training device 10 is fabricated of a molded homogenous plastic, and comprises a centerpoint 31, top side 32, bottom side 33 and a thick annular rim 34. As best shown in FIGS. 3 and 6, first and second ends of the nylon swivel strap 12A, 12B are folded at the centerpoint 31 of the disc 11, and define respective fastener holes 35, 36 aligned on top and bottom sides 32, 33 of the disc 11 with a centerpoint disc hole 38. An integ rally-molded annular reinforcement collar 39 is located at the centerpoint disc hole 38 and projects from the bottom side 33 of the disc 11. A cylindrical metal sleeve bearing 41 resides within the cylindrical opening defined by the reinforcement collar 39 at the centerpoint disc hole 38. With the sleeve bearing 41 closely assembled inside the reinforcement collar 39 and the fasteners holes 35, 36 of swivel strap 12 properly aligned with hole 38, complementary-threaded male and female fasteners 44, 45 are inserted through the swivel strap 12 and sleeve bearing 41 on respective top and bottom sides 32, 33 of the disc 11. The fasteners 44, 45 are tightened using a screwdriver or other conventional tool. As shown in FIG. 6, the sleeve bearing 41 is slighter longer than a combined depth and thickness of the disc 11 and reinforcement collar 39, thereby allowing the swivel strap 12 to freely pivot relative to the disc 11. The exemplary swivel strap 12 forms an intermediate loop 12C which extends beyond the annular rim 34 of the disc 11 and creates an attachment point for the elastic resistance band 14.

In one exemplary embodiment, the present training disc 11 is between 20-23 cm in diameter and weighs between 200 and 300 grams. The outer rim 34 of the training disc may have a beveled edge and a maximum thickness of between 2-4 cm, while the thin body portion of the disc inside the outer rim may have a thickness no greater than 1 cm. The exemplary disc 11 may be custom designed and molded for incorporating in the present training device 10.

In exemplary embodiments, the present training device 10 incorporates one or multiple elastic resistance bands 14—e.g., 5 pound and/or 8 pound bands. See FIG. 11. The resistance band 14 creates tension and stability in the torso throughout the disc golf throwing motion, while engaging multiple stabilizer muscles and enhancing coordination and balance. The exemplary resistance bands 14 are fabricated of double dipped, heavy-duty tubular latex, and may offer many different predetermined levels of resistance. The exemplary bands 14 are color-coded to indicate the different resistance levels. For example, green bands may indicate resistance of 5 to 8 pounds, red bands may indicate resistance of 8 to 12 pounds, blue bands may indicate resistance of 12 to 16 pounds, black bands may indicate resistance of 16 to 20 pounds, purple bands may indicate resistance of 20 to 30 pounds, navy bands may indicate resistance of 30 to 40 pounds, and brown bands may indicate resistance of 40 to 50 pounds. Each resistance band is 122 cm (48 inches) long and lightweight.

Figure 7:
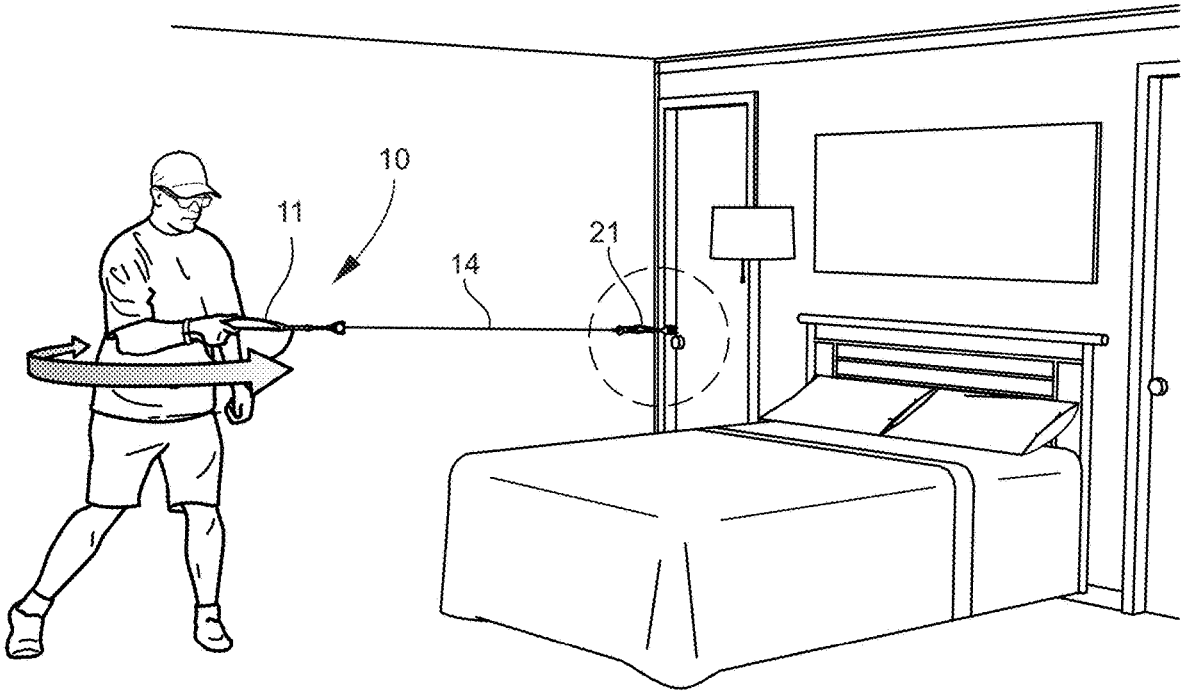
FIGS. 7 and 8 demonstrate indoor use of the exemplary training device.
Figure 8:
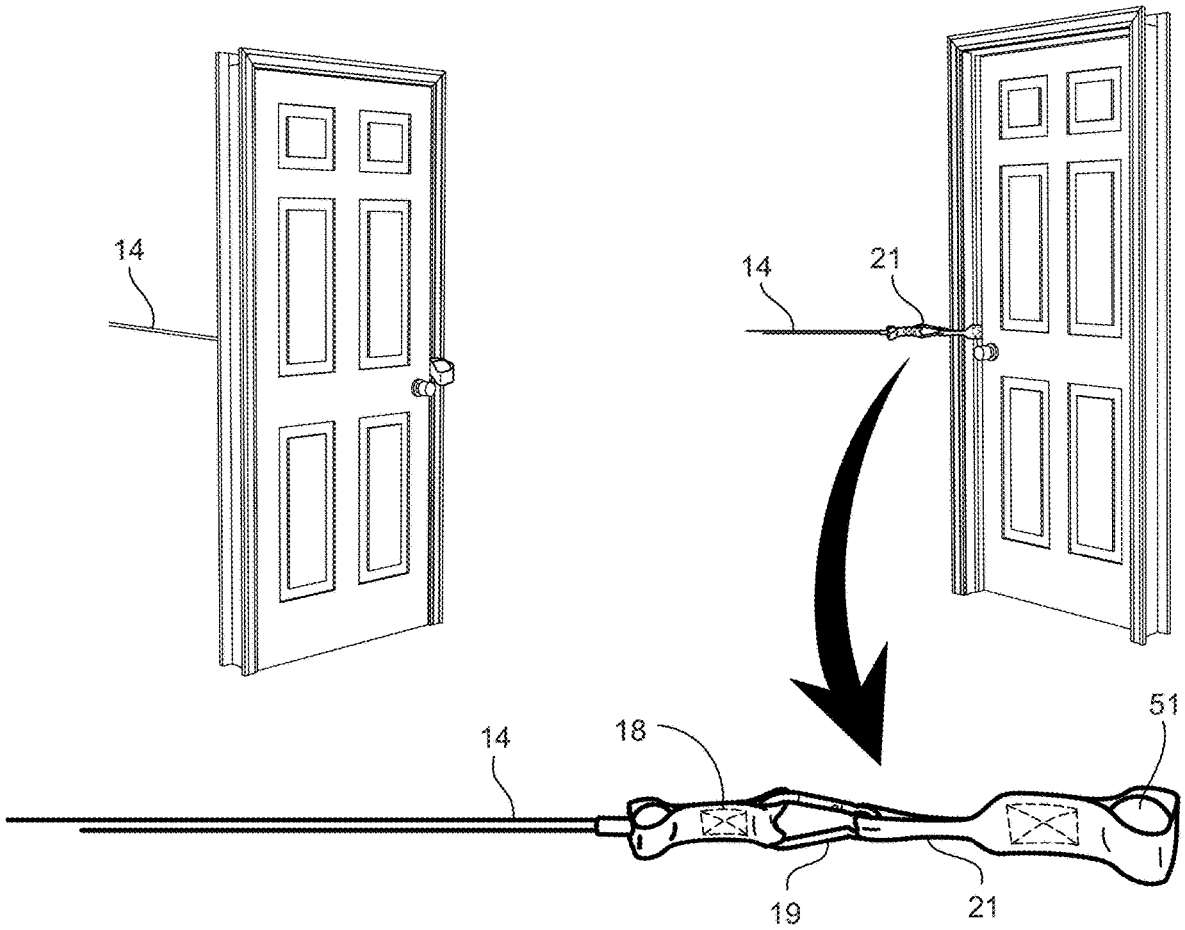
Figure 9:
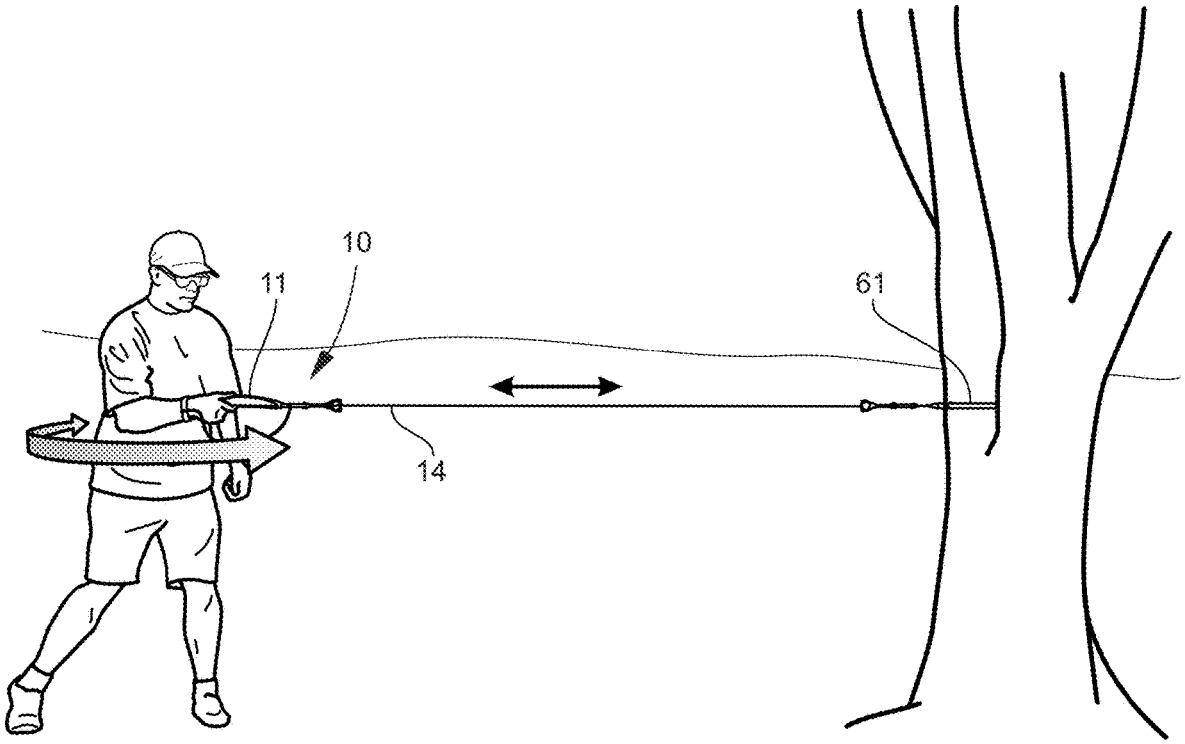
FIGS. 9 and 10 demonstrate outdoor use of the exemplary training device.
Figure 10:
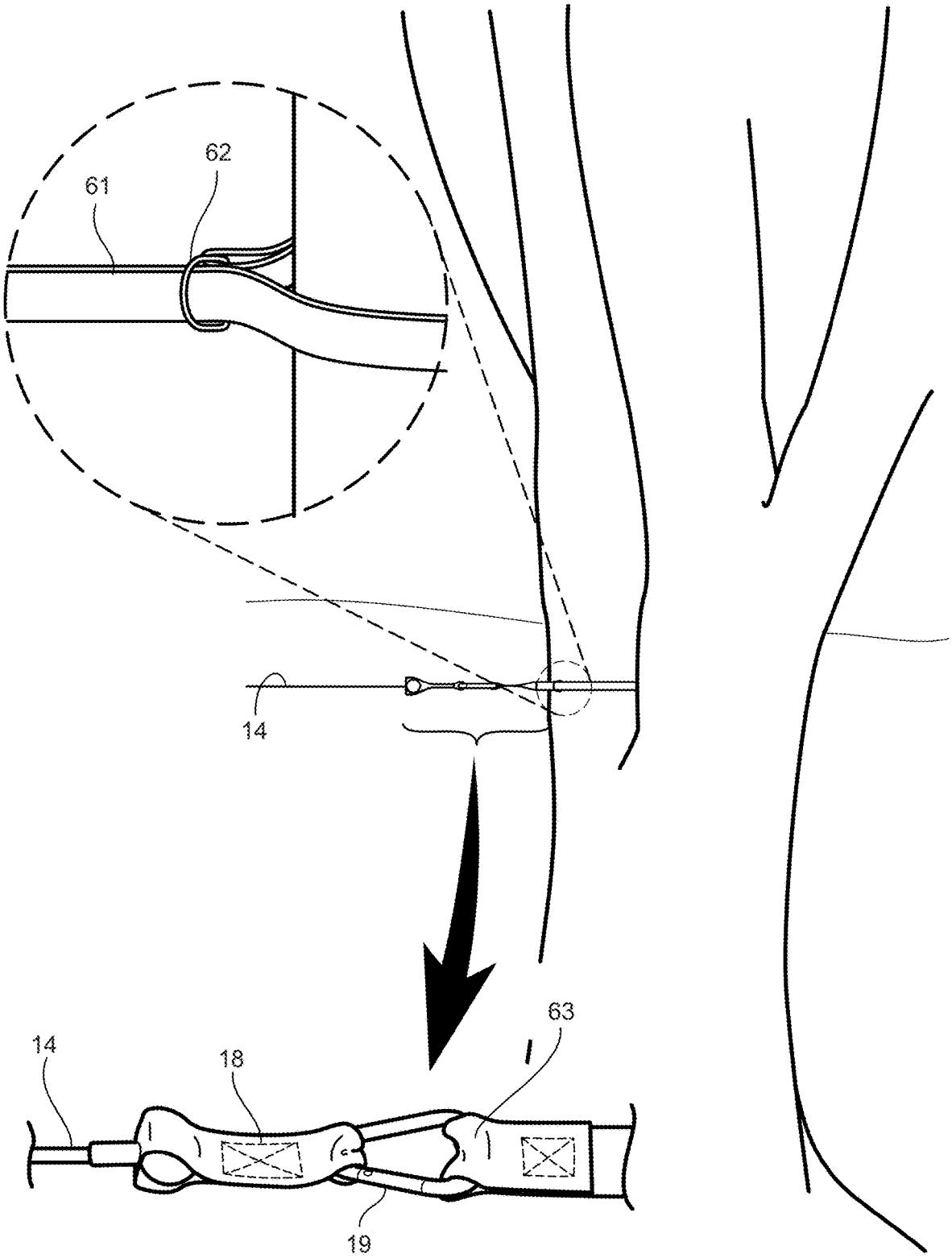

FIGS. 7-10 demonstrate exemplary uses of the present training device 10. In FIGS. 7 and 8, the detachable anchor strap 21 comprises a door anchor 51 designed for being wedged between a door and door frame for indoor training. The height of the door anchor 51 (and resistance band 14) should be set just above the elbow, and the safety wrist strap 23 applied and adjusted to the particular user. In use, the training disc 11 is moved by the user inline with a notional plane (trajectory) of the opposing force created by the tensioned resistance band 14, while also being inline with an imaginary target line of the disc golf throw. FIGS. 9 and 10 illustrate an alternative anchor strap 61 applicable for securing the training device 10 to a tree, utility pole, fence post, or other upright structure. The exemplary anchor strap 61 (or "tree strap") comprises elongated flexible nylon webbing designed to wrap around the tree and having a first looped end 62 (or D-ring) through which a second looped end 63 extends. The carabiner 19 of fabric coupler 18 releasably attaches to the looped end 63 to temporarily secure the resistance band 14 to the tree. As with indoor training, using a throwing motion, the user moves the training disc 11 inline with a notional plane of the opposing force created by the resistance band 14—the notional plane being inline with an imaginary target line of the disc golf throw. Attaching the training device 10 to a tree or other fixed outdoor structure, allows the user to quickly, conveniently and fully warm-up before competitions.

Figure 11:
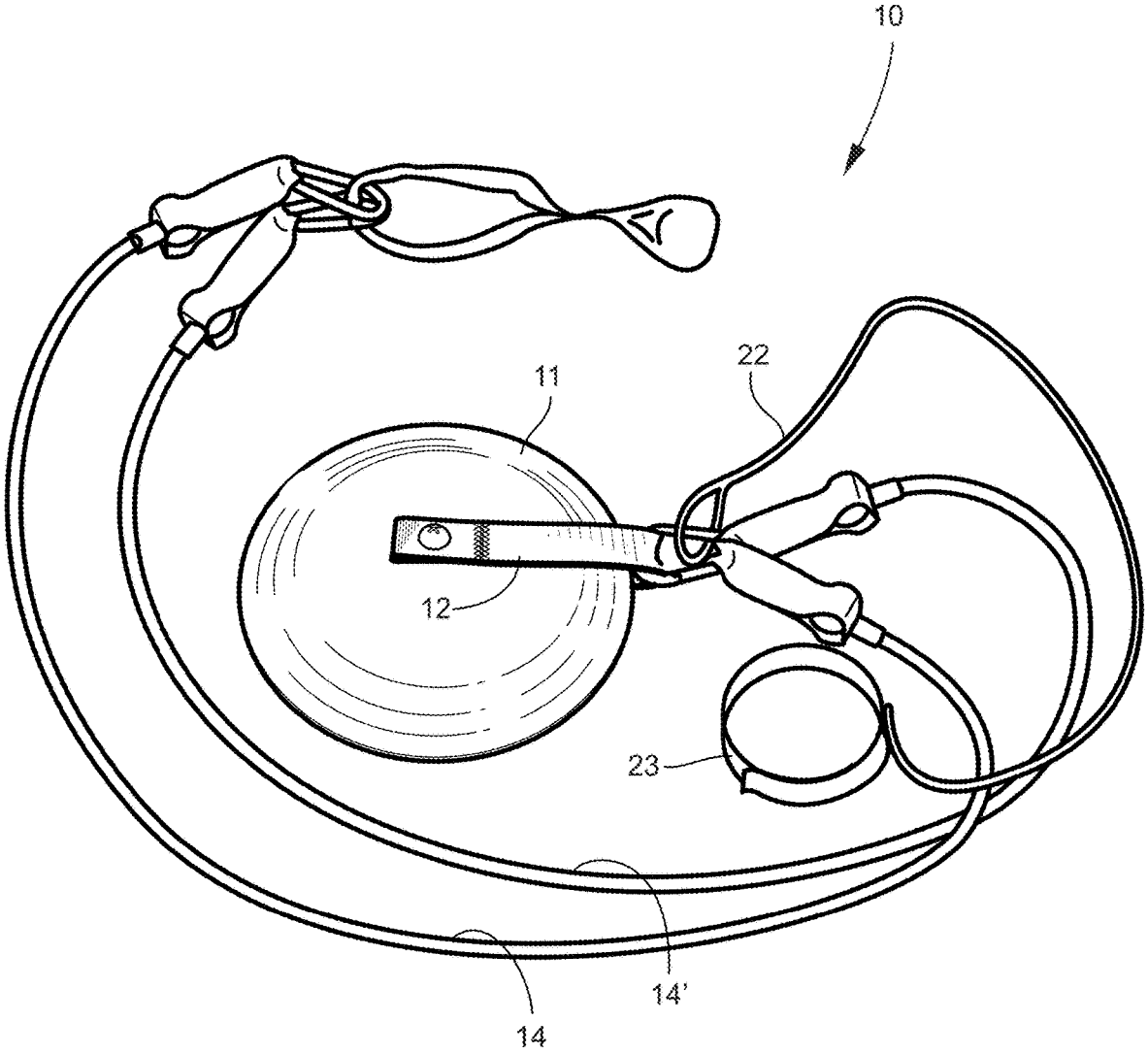
FIG. 11 illustrates a further exemplary embodiment of the present training device incorporating multiple elastic resistance bands.

In other embodiments, the present training device 10 may incorporate multiple elastic resistance bands 14, 14' such as shown in FIG. 11. The interchangeable elastic resistance bands 14, 14' combine to offer customized resistance levels of the exemplary training device 10.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A flying disc training device, comprising:

a training disc for being gripped by a user, and comprising a centerpoint, top and bottom sides and an annular rim, and wherein the annular rim comprises a beveled edge;

a swivel strap having first and second ends pivotably attached at the centerpoint of said disc on respective top and bottom sides, and forming an intermediate loop extending beyond the annular rim of said disc such that said swivel strap is capable of freely pivoting relative to said disc; and an elastic resistance band attached to said swivel strap and having a free end adapted for being secured to a fixed structure.

2. The flying disc training device according to claim 1, and comprising an exchangeable flexible anchor strap attached to the free end of said resistance band and adapted for being releasably secured to the fixed structure.

3. The flying disc training device according to claim 2, wherein said flexible anchor strap comprises a door anchor adapted for being wedged between a door and door frame.

4. The flying disc training device according to claim 2, wherein said anchor strap comprises a flexible nylon tree strap adapted for wrapping around a tree and having at least one looped end.

5. The flying disc training device according to claim 2, wherein the free end of said resistance band comprises a fabric band coupler and carabiner, said carabiner adapted for being releasably attached to said anchor strap.

6. The flying disc training device according to claim 1, wherein said resistance band comprises a fabric band coupler and carabiner, said carabiner adapted for being releasably attached to said swivel strap.

7. The flying disc training device according to claim 1, and comprising a flexible safety wrist tether releasably attached to said swivel strap.

8. The flying disc training device according to claim 7, wherein said wrist tether comprises an adjustable wrist strap.

9. The flying disc training device according to claim 1, and comprising a second elastic resistance band attached to said swivel strap and having a free end adapted for being secured to the fixed structure, said second resistance band combining with said first resistance band to increase a resistance level of said training device.

10. The flying disc training device according to claim 1, wherein the first and second ends of said swivel strap are folded at the centerpoint of said disc and define respective fastener holes aligned on top and bottom sides of said disc with a centerpoint disc hole.

11. The flying disc training device according to claim 10, and comprising an integrally-molded annular reinforcement collar located at the centerpoint disc hole and projecting from the bottom side of said disc.

12. The flying disc training device according to claim 11, and comprising a metal sleeve bearing residing within an opening defined by said reinforcement collar at the centerpoint disc hole.

13. The flying disc training device according to claim 12, and comprising complementary-threaded male and female fasteners inserted through said sleeve bearing on respective top and bottom sides of said disc.

14. The flying disc training device according to claim 1, wherein the annular rim of said training disc has a maximum thickness between 2-4 cm.

15. The flying disc training device according to claim 1, wherein said training disc is fabricated of a homogenous plastic.

16. The flying disc training device according to claim 1, wherein said training disc weighs between 200 and 300 grams.

17. The flying disc training device according to claim 1, wherein said training disc is between 20-23 cm in diameter.

18. The flying disc training device according to claim 1, wherein said elastic resistance band offers resistance levels of between 5 and 8 pounds.

19. The flying disc training device according to claim 1, wherein said elastic resistance band is color-coded to indicate a predetermined resistance level.

20. A flying disc training device, comprising:

a training disc for being gripped by a user, and comprising a centerpoint, top and bottom sides and an annular rim;

a swivel strap having first and second ends pivotably attached at the centerpoint of said disc on respective top and bottom sides, and forming an intermediate loop extending beyond the annular rim of said disc such that said swivel strap is capable of freely pivoting relative to said disc;

a first elastic resistance band attached to said swivel strap and having a free end adapted for being secured to a fixed structure; and a second elastic resistance band attached to said swivel strap and having a free end adapted for being secured to the fixed structure, said second elastic resistance band combining with said first elastic resistance band to increase a resistance level of said training device.

21. A flying disc training device, comprising:

a training disc for being gripped by a user, and comprising a centerpoint, top and bottom sides and an annular rim;

a swivel strap having first and second ends pivotably attached at the centerpoint of said disc on respective top and bottom sides, and forming an intermediate loop extending beyond the annular rim of said disc such that said swivel strap is capable of freely pivoting relative to said disc; and an elastic resistance band attached to said swivel strap and having a free end adapted for being secured to a fixed structure, and wherein said elastic resistance band is color-coded to indicate a predetermined resistance level.

* * * * *